US009502779B2

(12) United States Patent
Lee et al.

(10) Patent No.: US 9,502,779 B2
(45) Date of Patent: Nov. 22, 2016

(54) ANTENNA APPARATUS INCLUDING BROADCASTING ANTENNA AND COMMUNICATING ANTENNA RADIATOR FOR ELECTRONIC DEVICE

(71) Applicant: Samsung Electronics Co., Ltd., Suwon-si, Gyeonggi-do (KR)

(72) Inventors: Dong-Hyun Lee, Suwon-si (KR); Yong-Soo Kwak, Seoul (KR); Kyung-Kyun Kang, Suwon-si (KR); Cheol-Hong Son, Seoul (KR); Seong-Tae Jeong, Yongin-si (KR); Joon-Ho Byun, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 277 days.

(21) Appl. No.: 13/865,645

(22) Filed: Apr. 18, 2013

(65) Prior Publication Data

US 2013/0321217 A1 Dec. 5, 2013

(30) Foreign Application Priority Data

May 29, 2012 (KR) ..... 10-2012-0056959

(51) Int. Cl.

| | |
|---|---|
| ***H01Q 1/24*** | (2006.01) |
| ***H01Q 21/00*** | (2006.01) |
| ***H01Q 1/52*** | (2006.01) |
| ***H01Q 21/30*** | (2006.01) |

(52) U.S. Cl.

CPC ..... *H01Q 21/0006* (2013.01); *H01Q 1/243* (2013.01); *H01Q 1/244* (2013.01); *H01Q 1/521* (2013.01); *H01Q 21/30* (2013.01)

(58) Field of Classification Search

CPC .. H01Q 21/0006; H01Q 1/244; H01Q 1/243; H01Q 1/521; H01Q 21/30

USPC ..... 343/702, 893, 751, 879

See application file for complete search history.

(56) References Cited

U.S. PATENT DOCUMENTS

| | | | | |
|---|---|---|---|---|
| 6,195,050 | B1 * | 2/2001 | Kim | 343/700 MS |
| 2005/0243015 | A1 | 11/2005 | Kfoury et al. | |
| 2010/0220028 | A1 | 9/2010 | Cho et al. | |
| 2011/0050522 | A1 | 3/2011 | Kuo | |

FOREIGN PATENT DOCUMENTS

| | | | | |
|---|---|---|---|---|
| EP | 0 945 917 | A2 * | 9/1999 | H01Q 21/28 |
| EP | 1 193 797 | A2 | 4/2002 | |
| GB | 2335312 | A * | 9/1999 | H01Q 21/30 |
| KR | 10-2009-0032316 | A | 4/2009 | |
| WO | 01/82409 | A1 | 11/2011 | |

OTHER PUBLICATIONS

Almeida et al., The ARRL Antenna Book, 1988, The American Radio Relay League, 15th Edition, 2-24, 25.*

* cited by examiner

*Primary Examiner* — Sue A Purvis
*Assistant Examiner* — Jae Kim
(74) *Attorney, Agent, or Firm* — Jefferson IP Law, LLP

(57) ABSTRACT

An antenna apparatus for an electronic device is provided. The antenna apparatus includes a broadcasting antenna apparatus for receiving broadcasting, and a communicating antenna radiator arranged near the broadcasting antenna apparatus and fed simultaneously from a feed part of the broadcasting antenna apparatus.

15 Claims, 8 Drawing Sheets

ANTENNA APPARATUS INCLUDING BROADCASTING ANTENNA AND COMMUNICATING ANTENNA RADIATOR FOR ELECTRONIC DEVICE

PRIORITY

This application claims the benefit under 35 U.S.C. §119 (a) of a Korean patent application filed on May 29, 2012 in the Korean Intellectual Property Office and assigned Serial No. 10-2012-0056959, the entire disclosure of which is hereby incorporated by reference.

BACKGROUND OF THE INVENTION

1. Field of the Invention

The present invention relates to an electronic device. More particularly, the present invention relates to an antenna apparatus for an electronic device.

2. Description of the Related Art

In recent years, portable electronic devices evolved into smart phones capable of providing various functions to meet users' desires. For example, the portable electronic device can listen to a variety of music using Motion Picture Experts Group (MPEG) Audio Layer-3 (MP3) sources, enjoy web browsing using wireless Internet, or download various programs using this connection, in addition to a basic telephone call function with a called party.

The portable electronic device is equipped with at least one high-pixel image pickup device (i.e., a camera lens assembly) and thus can take a picture of a subject. Particularly, there is a recent tendency that a function of taking not only a still picture but also a moving picture, and more specifically, a 3-dimensional (3D) picture, is becoming more common.

Further, the portable electronic device includes a broadcasting communication module and a broadcasting antenna apparatus, and thus is able to receive terrestrial broadcasting through a display. This communication terminal can provide broadcasts chiefly divided into Terrestrial Digital Multimedia Broadcasting (TDMB) (Korea), Digital Video Broadcasting-Handheld (DVB-H) (Europe), One Seg (Japan), Integrated Services Digital Broadcasting-Terrestrial (ISDB-T) (Central and South America), and the like, for example.

In general, a broadcasting antenna apparatus is built in the electronic device to have a predetermined length (commonly, 100 millimeters (mm) to 110 mm) according to a Radio Frequency (RF) characteristic. The broadcasting antenna apparatus is constructed in a retractable type such that, at broadcasting reception, a user can extend the broadcasting antenna apparatus from the electronic device to the maximum for use and, at broadcasting non-reception, the user can retract the broadcasting antenna apparatus into the electronic device to increase the ease of carrying.

On the other hand, it is a development tendency that while the electronic device provides all various functions, an aesthetic design often changes to be more pleasing and physically smaller. Accordingly, device manufacturers are racing to minimize the electronic device while developing better corresponding functions of assemblies included in the electronic device, and as a result reducing the volume of the electronic device.

Particularly, in addition to the communicating main antenna apparatus, various supplementary antenna apparatuses such as a WiFi antenna apparatus, a Global Positioning System (GPS) antenna apparatus, and a Long Term Evolution (LTE) sub-antenna apparatus are all mounted in one electronic device. Therefore, if the respective antenna apparatuses are positioned near each other, they may suffer mutual interference due to coupling and, as a result, radiation performance of a corresponding function may degrade. Accordingly, device manufacturers are focusing on developing installation space allotment capable of avoiding mutual interference between these antenna apparatuses while reducing a wasted space of the electronic device.

Particularly, if the communicating antenna apparatus is installed around the broadcasting antenna apparatus, the communicating antenna apparatus goes through performance degradation due to unexpected coupling with the broadcasting antenna apparatus. For example, the communicating antenna apparatus installed around the broadcasting antenna apparatus suffers performance variation depending on the extension and retraction of the retractable type broadcasting antenna apparatus. This is a cause of reducing the reliability and usability of the electronic device.

Accordingly, to mitigate the performance degradation, other antenna apparatuses should not be installed around the broadcasting antenna apparatus, and more specifically, should not be installed around a bushing fed from a broadcasting module of a substrate (e.g., a Printed Circuit Board (PCB)) and installed to support the broadcasting antenna apparatus and its supplementary connection means (e.g., a C-clip). This wasted space is a problem with regard to the recent trend of device slimming and multifunction.

Therefore, a need exists for a system and method for an antenna apparatus for an electronic device that provides multi antenna use while minimizing interference and wasted space.

The above information is presented as background information only to assist with an understanding of the present disclosure. No determination has been made, and no assertion is made, as to whether any of the above might be applicable as prior art with regard to the present invention.

SUMMARY OF THE INVENTION

Aspects of the present invention are to address at least the above-mentioned problems and/or disadvantages and to provide at least the advantages below. Accordingly, an aspect of the present invention is to provide an antenna apparatus for an electronic device realized to minimize a wasted space of the electronic device, thereby reducing a size of the electronic device.

Another aspect of the present invention is to provide an antenna apparatus for an electronic device configured to, while a communicating antenna apparatus is installed near a broadcasting antenna apparatus, allow the communicating antenna apparatus to maintain the same performance irrespective of an operation of the broadcasting antenna apparatus, thereby improving a reliability and usability of the electronic device.

Another aspect of the present invention is to provide an antenna apparatus for an electronic device configured to install a communicating antenna apparatus in a wasted space near a broadcasting antenna apparatus, and allow the communicating antenna apparatus to have the same feed point as the broadcasting antenna apparatus, thereby preventing a performance degradation of the communicating antenna apparatus and reducing the size of the electronic device.

The above aspects are addressed by providing an antenna apparatus for an electronic device.

In accordance with an aspect of the present invention, an antenna apparatus for an electronic device is provided. The antenna apparatus includes a broadcasting antenna apparatus for receiving broadcasting, and one or more communicating antenna radiator arranged near the broadcasting antenna apparatus and fed simultaneously from a feed part of the broadcasting antenna apparatus.

According to another aspect of the present invention, the feed part of the broadcasting antenna apparatus is arranged in a substrate of the electronic device, and the broadcasting antenna apparatus is supported by a metal bushing electrically connected with the feed part of the broadcasting antenna apparatus and operates as a retractable manner in the electronic device.

According to yet another aspect of the present invention, the communicating antenna radiator is in direct contact with the bushing or is electrically connected with the broadcasting antenna feed part by means of at least one of a metal contact part fixed to the bushing, a plurality of metal protrusions, a C-clip, and metal screw coupling.

The communicating antenna pattern can be installed in an external surface or internal surface of the case frame of the electronic device, or in an insert-molding insertion. Further, the communicating antenna pattern can be a constant shape pattern, which is formed in a pattern form in the substrate to be electrically connected with the broadcasting antenna feed part arranged in the substrate.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In an exemplary embodiment of the present invention, an electronic device is described as a communicating portable terminal having a broadcasting antenna apparatus for broadcasting reception, but this does not intend to limit the scope and spirit of the invention. It will be obvious to those skilled in the art to be applicable to various devices, for example, a Personal Digital Assistant (PDA) having a communication function of voice, video, data transmission/reception, and the like by a communication module and a communicating antenna apparatus other than a broadcasting antenna apparatus for broadcasting reception, a laptop computer, a smart phone, a netbook, a Mobile Internet Device (MID), a Ultra Mobile Personal Computer (UMPC), a tablet PC, a navigator, and the like.

Figure 1:
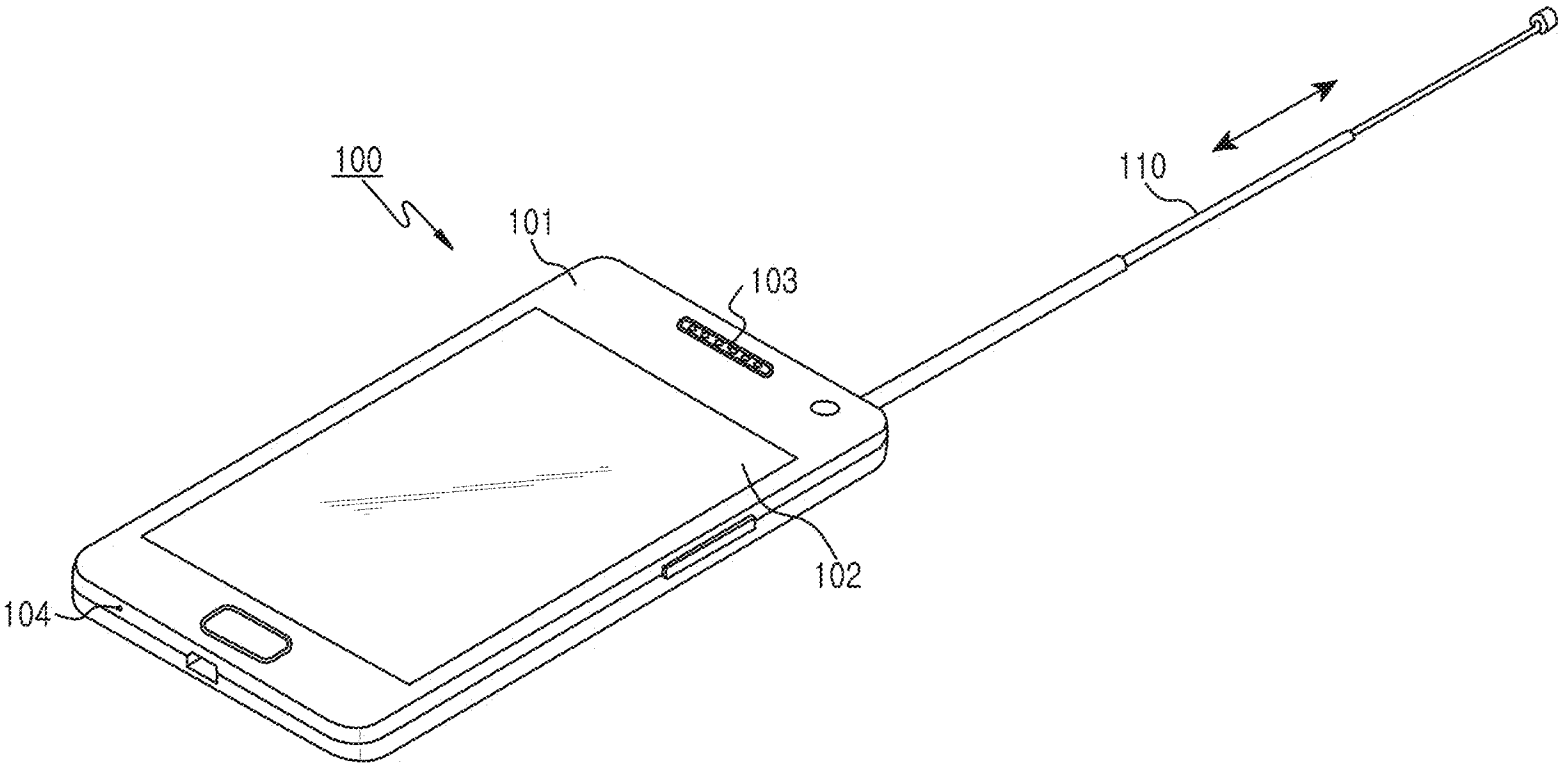
FIG. 1 is a perspective view illustrating a construction of an electronic device including a broadcasting antenna apparatus according to an exemplary embodiment of the present invention.

FIG. 1 is a perspective view illustrating a construction of an electronic device 100 including a broadcasting antenna apparatus according to an exemplary embodiment of the present invention.

Referring to FIG. 1, the electronic device 100 according to an exemplary embodiment of the present invention is illustrated as a communicating portable terminal. As illustrated, a display unit 102 is arranged on a front surface 101 of the electronic device 100, an earpiece 103 is installed above the display unit 102, and a microphone 104 is installed under the display unit 102. The microphone 104 is used for voice call with a called party. A retractable type broadcasting antenna apparatus 110 is installed at a top end of the electronic device 100. When the broadcasting antenna apparatus 110 is not used, i.e., when a user does not watch broadcasting, the user maintains the broadcasting antenna apparatus 110 in a state of full retraction into the electronic device 100, and thus improves portability. In contrast, when the user watches the broadcasting using the display unit 102, the user positions the broadcasting antenna apparatus 110 in a state of full extension from the electronic device 100, that is, in the best state to receive a broadcast signal, and then the user watches the broadcasting. Although not illustrated, the broadcasting antenna apparatus 110 may be realized to be rotatable when in a state of full extension in the longitudinal direction of the electronic device 100.

Figure 2:
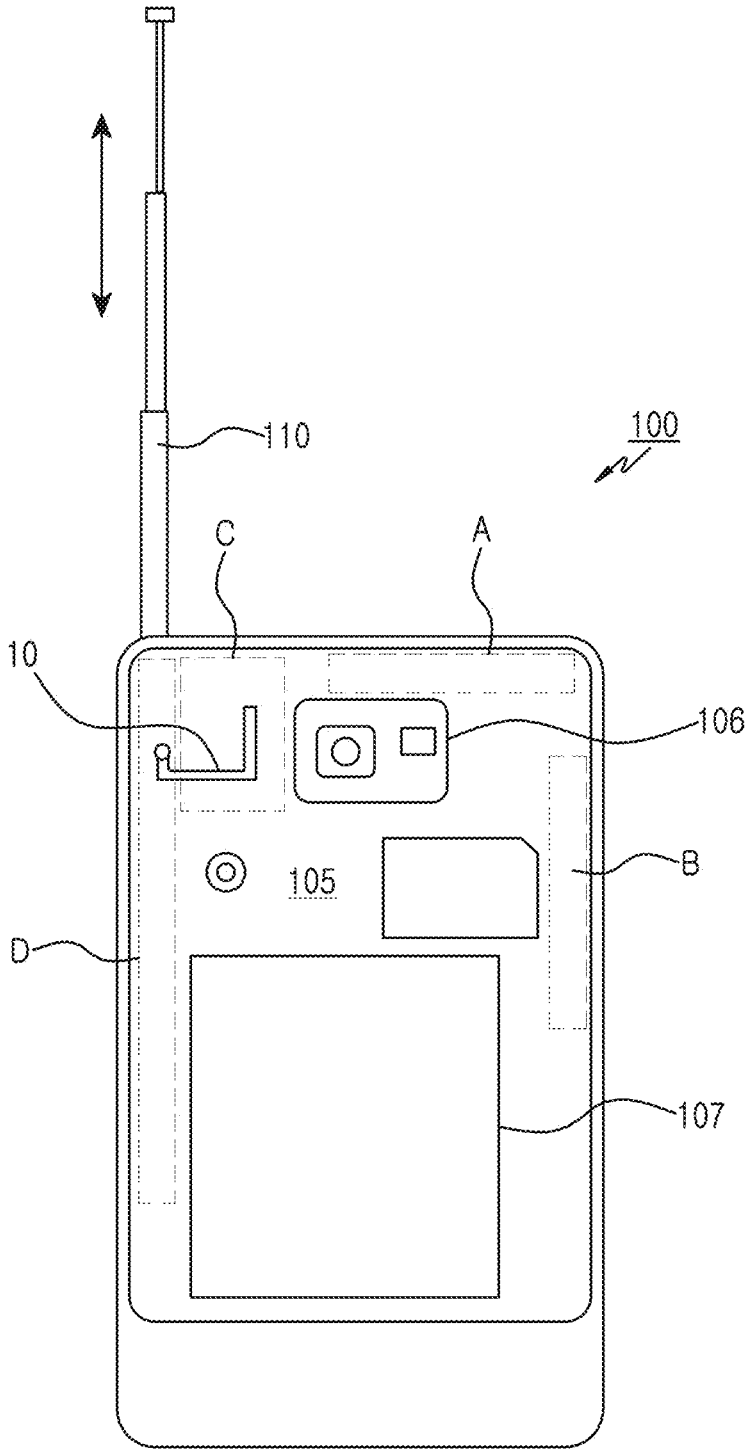
FIG. 2 is a construction diagram illustrating a state in which the broadcasting antenna apparatus of FIG. 1 and a communicating antenna apparatus are installed together according to an exemplary embodiment of the present invention.

FIG. 2 is a construction diagram illustrating a state in which the broadcasting antenna apparatus of FIG. 1 and a communicating antenna apparatus are installed together according to an exemplary embodiment of the present invention.

FIG. 2 illustrates a rear surface 105 of the electronic device 100. FIG. 2 illustrates a state in which a battery cover is detached from the rear surface 105 so that components beneath the cover can be seen. A battery pack 107 for supplying a power source to the electronic device 100 is installed in the rear surface 105 of the electronic device 100, and various devices for supplementary functions, for example, a camera lens assembly 106 and the like, can be installed in the rear surface 105 of the electronic device 100.

A housing space D is provided at one side of the electronic device 100, and houses the broadcasting antenna apparatus 110 in a longitudinal direction. In the related art, a separate communicating antenna apparatus could not be installed in a space C near the broadcasting antenna apparatus 110 because the radiation characteristic of the communicating antenna apparatus was deteriorated due to a coupling with the broadcasting antenna apparatus 110. Accordingly, to avoid interference between the antenna apparatuses, the communicating antenna apparatus of the related art was installed in a space A or B, which are spaced farther apart from the broadcasting antenna apparatus 110. This wasted space C caused a problem of undesirably increasing a size of the electronic device 100.

To address this problem, an exemplary embodiment of the present invention installs a communicating antenna apparatus 10 in the space C near the broadcasting antenna apparatus 110. Although the communicating antenna apparatus 10 is installed in the space C near the broadcasting antenna apparatus 110, the radiation performance of the communicating antenna apparatus 10 is not deteriorated, because the communicating antenna apparatus 10 is not interfered with by the broadcasting antenna apparatus 110. This is because the communicating antenna apparatus 10 is arranged to have the same feed point as the broadcasting antenna apparatus 110 according to an exemplary embodiment of the present invention.

Figure 3:
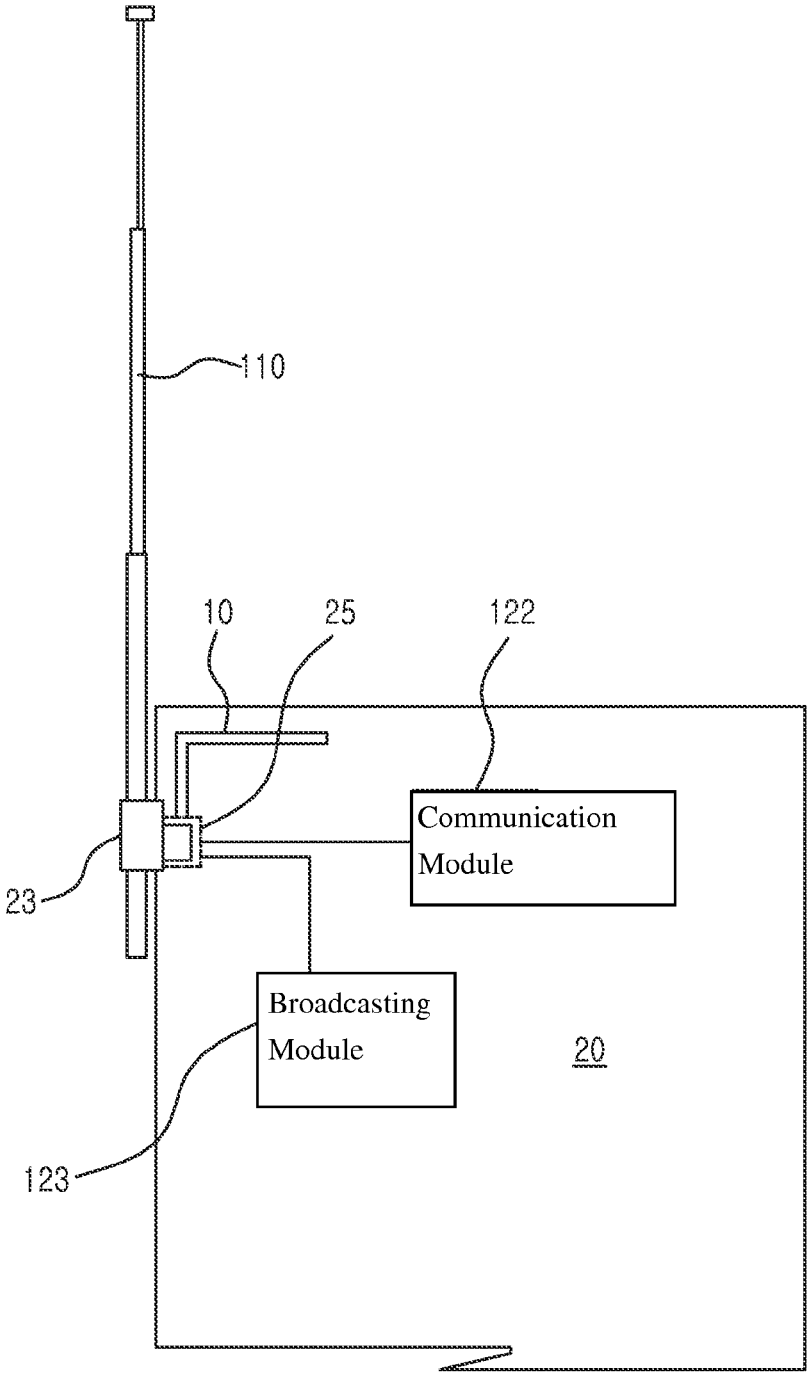
FIG. 3 is a schematic diagram illustrating a construction of an electronic device in which the broadcasting antenna apparatus of FIG. 1 is constructed to have the same feed point as a communicating antenna apparatus on a substrate according to an exemplary embodiment of the present invention.
Figure 4:
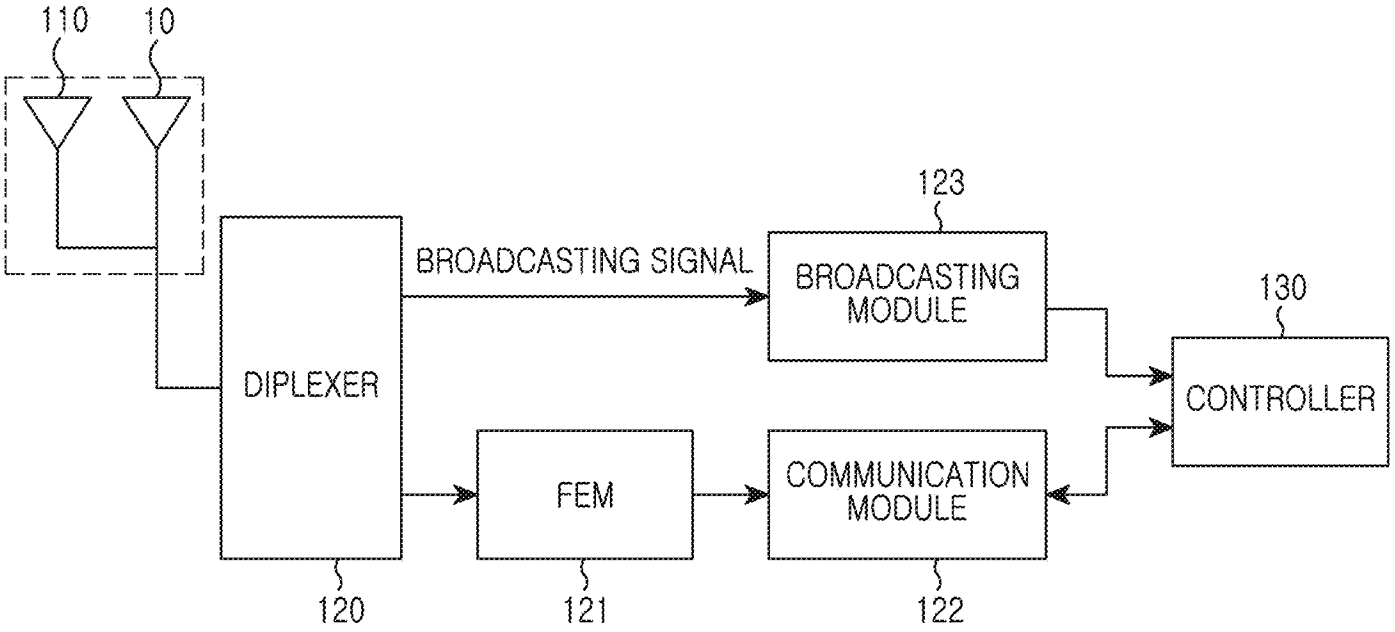
FIG. 4 is a block diagram illustrating a construction of an electronic device in which the broadcasting antenna apparatus of FIG. 1 is constructed to have the same feed point as a communicating antenna apparatus according to an exemplary embodiment of the present invention.

FIG. 3 is a schematic diagram illustrating a construction of an electronic device in which the broadcasting antenna apparatus 110 of FIG. 1 is constructed to have the same feed point as a communicating antenna apparatus 10 on a substrate according to an exemplary embodiment of the present invention. FIG. 4 is a block diagram illustrating the construction of the electronic device in which the broadcasting antenna apparatus 110 of FIG. 1 is constructed to have the same feed point as the communicating antenna apparatus 10 according to an exemplary embodiment of the present invention.

Referring to FIGS. 3 and 4, a feed structure of the communicating antenna apparatus 10 according to an exemplary embodiment of the present invention is described below. A communication module 122 and a broadcasting module 123 are separately installed in a substrate (e.g., a Printed Circuit Board (PCB)) 20. Also, a broadcasting antenna feed part 25 is arranged in the substrate 20, and feeds the broadcasting antenna apparatus 110. A metal bushing 23 is installed around the broadcasting antenna feed part 25 arranged in the substrate 20, and supports the broadcasting antenna apparatus 110. The metal bushing 23 is constructed to electrically connect to the broadcasting antenna feed part 25. The metal bushing 23 can be electrically connected directly to the broadcasting antenna feed part 25 of the substrate 20. When the metal bushing 23 is installed apart from the substrate 20, the metal bushing 23 can be electrically connected with the broadcasting antenna feed part 25 of the substrate 20 by means of a separate electrical connection means, for example, a C-clip.

The communicating antenna apparatus 10 is electrically connected to the broadcasting antenna feed part 25. The broadcasting antenna feed part 25 is electrically connected to the communication module 122 of the substrate 20 in a pattern way and the like. As a result, the communicating antenna apparatus 10 is fed from the broadcasting antenna feed part 25 instead of using a separate communicating feed part, together with the broadcasting antenna apparatus 110.

Accordingly, the broadcasting antenna apparatus 110 of the electronic device 100 and the communicating antenna apparatus 10 thereof filter a broadcasting signal and a communication signal through a diplexer 120, respectively. The broadcasting signal is processed by the broadcasting module 123 (i.e., modulator/demodulator (modem)) and is provided to a controller 130 of the electronic device 100. The communication signal is RF-amplified by a Front End Module (FEM) 121, and is provided to the communication module (i.e., modem) 122, and is finally processed by the controller 130.

FIGS. 5A to 5E are diagrams illustrating various installation examples in which the broadcasting antenna apparatus 110 of FIG. 1 is constructed to have the same feed point as the communicating antenna apparatus 10 according to an exemplary embodiment of the present invention.

Referring to FIGS. 5A to 5E, the broadcasting antenna apparatus 110 according to an exemplary embodiment of the present invention is fixed to the substrate 20 or near the substrate 20 and is supported by the metal bushing 23 electrically connected with the broadcasting antenna feed part 25 (not shown). Accordingly, the communicating antenna apparatus 10 should also be constructed to electrically connect to the metal bushing 23.

Figure 5A:
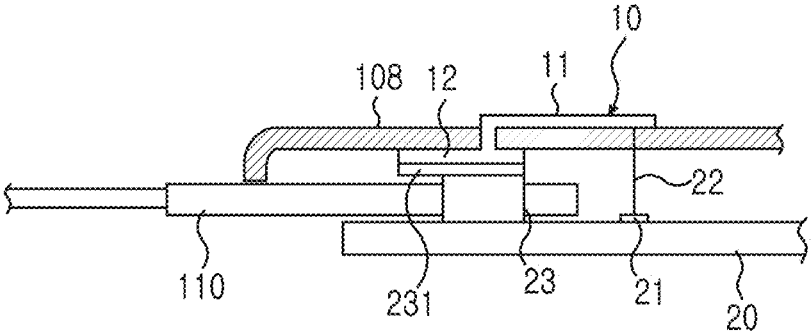
FIGS. 5A to 5E are diagrams illustrating various installation examples in which the broadcasting antenna apparatus of FIG. 1 is constructed to have the same feed point as a communicating antenna apparatus according to an exemplary embodiment of the present invention.

FIG. 5A illustrates a construction in which the communicating antenna apparatus 10 is attached to an external surface of a case frame 108 of the electronic device 100. A pattern 11 of the communicating antenna apparatus 10 is fixed in such a manner that it is attached to the external surface of the case frame 108. One end of the pattern 11 is formed as a feed end 12, and has a construction of passing through the case frame 108 and electrically connecting in contact with a contact part 231 fixed to the bushing 23. In an exemplary embodiment, the other end of the pattern 11 can be electrically connected with a capacitor 21 arranged in the substrate 20 by means of a predetermined electrical connection means 22 to form a closed-loop antenna. As the electrical connection means 22, a thin wire cable, a Flexible Printed Circuit (FPC), and the like can be used variously.

Figure 5B:
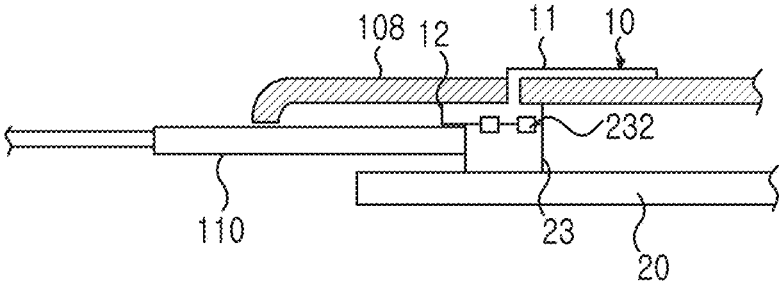

FIG. 5B illustrates a construction in which a communicating antenna apparatus 10 is attached to an external surface of a case frame 108 of the electronic device 100. A pattern 11 of the communicating antenna apparatus 10 is fixed in such a manner that it is attached to the external surface of the case frame 108. One end of the pattern 11 is formed as a feed end 12, and passes through the case frame 108 and is fixed and electrically connected to a plurality of metal protrusions 232 formed in the bushing 23.

Figure 5C:
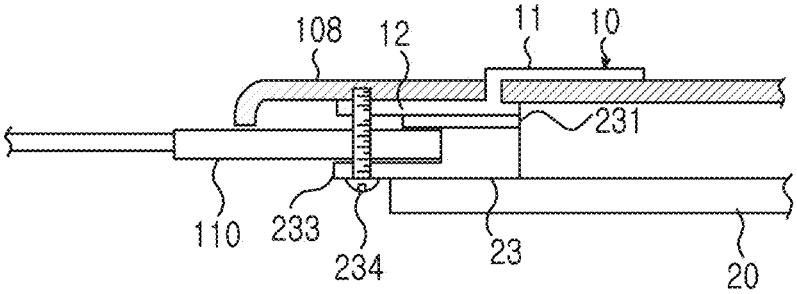

FIG. 5C illustrates a construction in which a communicating antenna apparatus 10 is attached to an external surface of a case frame 108 of the electronic device 100. A pattern 11 of the communicating antenna apparatus 10 is fixed in such a manner that it is attached to the external surface of the case frame 108. One end of the pattern 11 is formed as a feed end 12, and passes through the case frame 108 and is electrically connected to a metal contact part 231 fixed to the bushing 23.

In this construction, the communicating antenna apparatus 10 can be fixed in such a manner that it passes through a screw coupling part 233 of the bushing 23 and is coupled to the feed end 12 of the communicating antenna apparatus 10 by a metal screw 234. Accordingly, the communicating antenna radiator 10 can be firmly fixed to the case frame 108 of the electronic device 100 by the screw 234 coupling.

Figure 5D:
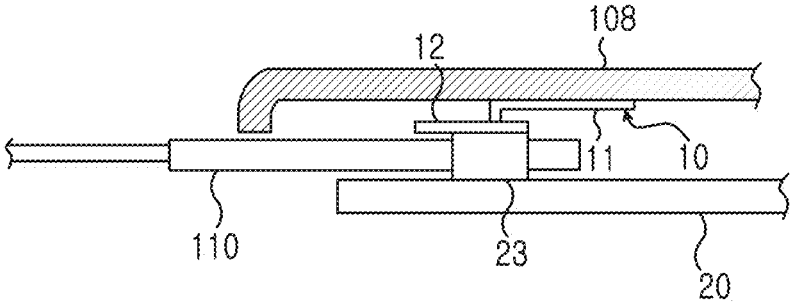

FIG. 5D illustrates a construction in which a communicating antenna apparatus 10 is attached to an inner surface of a case frame 108 of the electronic device 100. A pattern 11 of the communicating antenna apparatus 10 is fixed in such a manner that it is attached to the inner surface of the case frame 108. The pattern 11 of the communicating antenna apparatus 10 may have a construction in which, when the case frame 108 and the substrate 20 are assembled to each other, a feed end 12 of the communicating antenna apparatus 10 is electrically connected in contact with the bushing 23 in a natural way. This is advantageous when an antenna installation space for installing the communicating antenna apparatus 10 in the external surface of the case frame 108 is insufficient.

Figure 5E:
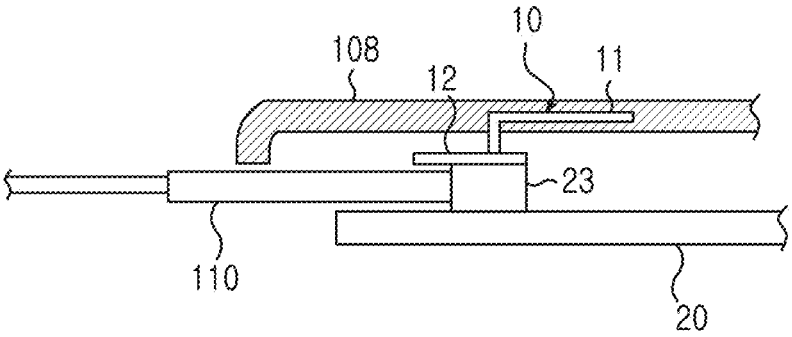

FIG. 5E illustrates a construction in which a pattern 11 of a communicating antenna apparatus 10 is insert-molded into a case frame 108 of the electronic device 100. By the insert-molding, the pattern 10 of the communicating antenna apparatus 10 is fixed into the case frame 108, and a feed end 12 protruding to an inner surface of the case frame 108 has a construction of electrical connection to the busing 23. This is advantageous when an antenna installation space for installing the communicating antenna apparatus 10 in either of an external surface of the case frame 108 and an inner surface thereof is insufficient.

The present disclosure illustrates exemplary implementations in which the communicating antenna apparatuses 10 are all applied to the case frame 108 of the electronic device 100. But, these are not intended to limit the scope and spirit of the invention. For example, the communicating antenna apparatus 10 can have various fixing structures in which the communicating antenna apparatus 10 is fixed to the bushing 23 electrically connecting with the broadcasting antenna feed part 25 of the substrate 20, together with the broadcasting antenna apparatus 110, such that they can be fed simultaneously from the broadcasting antenna feed part 25. Further, the communicating antenna apparatus 10 can be of various self-supporting forms in which the communicating antenna apparatus 10 is fixed to the bushing 23 but, instead of being in contact with the case frame 108, is maintained in a pattern form in a space between the case frame 108 and the substrate 20.

Although not illustrated, if a space is available, it does not matter that the communicating antenna apparatus 10 is formed to have a specific pattern form in the substrate 20 and is electrically connected with the broadcasting antenna feed part 20.

The communicating antenna apparatus 10 according to an exemplary embodiment of the present invention includes an implementation as a communicating antenna radiator. Or, the communicating antenna apparatus 10 can include not only the communicating antenna radiator but also a communication module and an electrical connection means for electrically connecting the communication module with the antenna radiator.

The pattern 11 of the communicating antenna apparatus 10 and the feed end 12 thereof according to an exemplary embodiment of the present invention are formed integrally. But, the pattern 11 and the feed end 12 can be isolated from each other if an electrical connection construction is available between the pattern 11 and the feed end 12 without departing from the scope and spirit of the invention. Also, the communicating antenna apparatus 10 can be realized by various conductors such as a metal plate, an FPC, and the like.

The communicating antenna apparatus 10 is described as fixed to the case frame 108 of the electronic device 100 in a bonding way, but other known fixing ways such as ultrasonic welding and the like may be substituted without departing from the scope or spirit of the invention.

Further, it will be obvious to those skilled in the art that various communicating antenna apparatuses such as the known WiFi antenna apparatus, Global Positioning System (GPS) antenna apparatus, Bluetooth antenna apparatus, Long Term Evolution (LTE) additional antenna apparatus, main band diversity antenna apparatus, and the like can be applied as the communicating antenna apparatus 10.

Also, in an exemplary embodiment of the present invention, the broadcasting antenna apparatus can be Terrestrial Digital Multimedia Broadcasting (TDMB), Digital Video Broadcasting-Handheld (DVB-H), One Seg, Integrated Services Digital Broadcasting-Terrestrial (ISDB-T), and the like.

Figure 6:
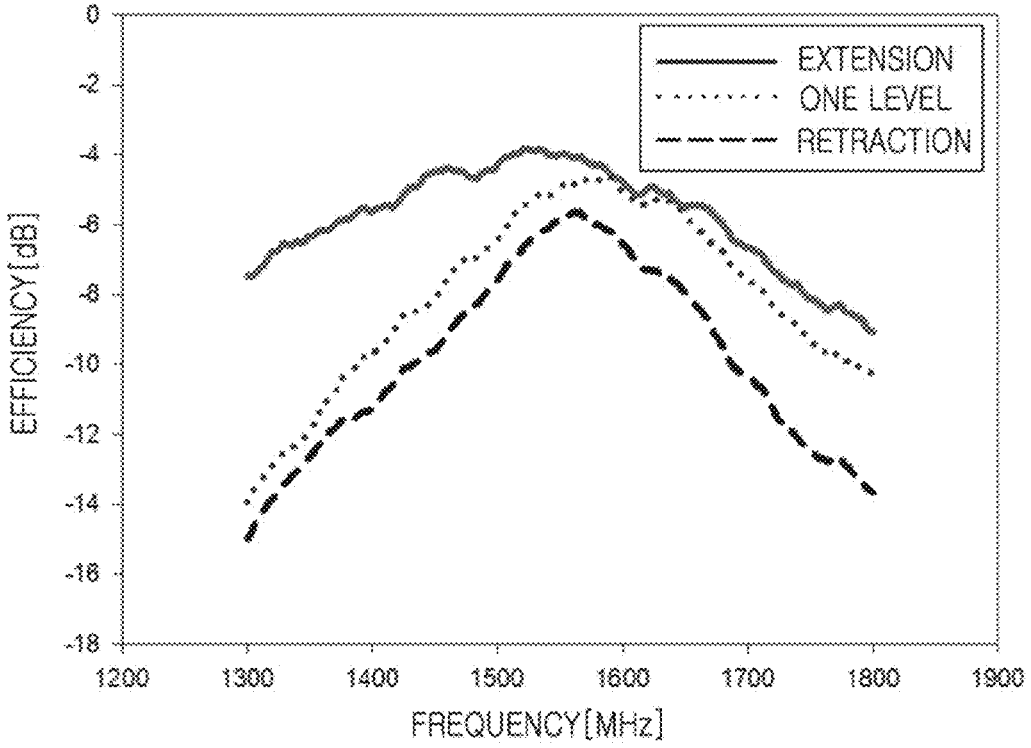
FIGS. 6 and 7 are graphs illustrating the efficiency of a communicating antenna apparatus arranged near a broadcasting antenna apparatus and a reflection coefficient thereof at retraction and extension of the broadcasting antenna apparatus according to an exemplary embodiment of the present invention.
Figure 7:
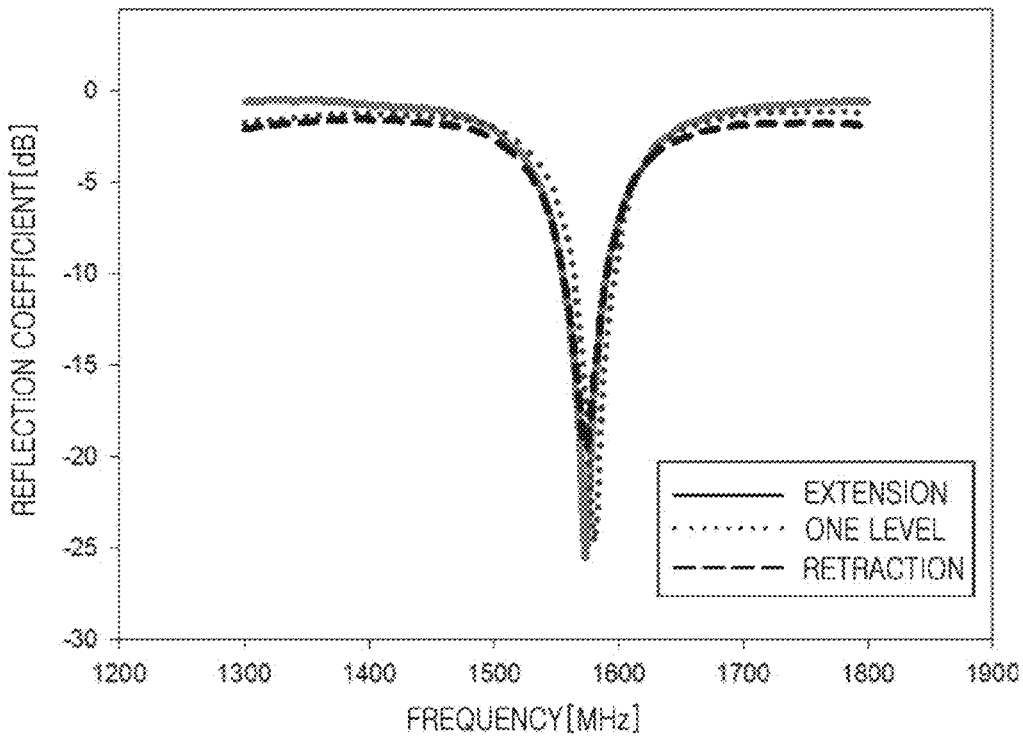

FIGS. 6 and 7 are graphs illustrating comparisons between gains and reflection coefficients of a communicating antenna apparatus arranged near a broadcasting antenna apparatus at retraction and extension of the broadcasting antenna apparatus according to an exemplary embodiment of the present invention. The experiment was carried out in which a GPS communicating antenna apparatus was arranged in a conventional wasted space near a broadcasting antenna apparatus. As illustrated, it could be appreciated that the reflection coefficients and gains were not greatly varied irrespective of the retraction and extension operation of the broadcasting antenna apparatus.

That is, it can be appreciated that the communicating antenna apparatus does not suffer the degradation of radiation performance, although an exemplary embodiment of the present invention installs the communicating antenna apparatus in the wasted space near the broadcasting antenna apparatus, whereas the related art device could install nothing in the wasted space near the broadcasting antenna apparatus without negatively impacting the use thereof.

As described above, exemplary embodiments of the present invention have an effect of, by configuring the communicating antenna apparatus to have the same feed point as the broadcasting antenna apparatus, while the communicating antenna apparatus is installed in the wasted space near the broadcasting antenna apparatus, allowing the communicating antenna apparatus to maintain constant radiation performance irrespective of an operation of the broadcasting antenna apparatus, thus improving the reliability and usability of the device, and contributing to a minimized size of the device.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. An antenna apparatus for an electronic device, comprising:

a broadcasting reception antenna configured to receive broadcasting; and at least one communicating antenna radiator arranged near the broadcasting reception antenna and galvanically connected to a feed part of the broadcasting reception antenna, wherein the communicating antenna radiator is arranged in proximity to the broadcasting reception antenna such that the communicating antenna radiator and the broadcasting reception antenna would mutually interfere due to coupling if galvanically isolated from each other, wherein the feed part of the broadcasting reception antenna is arranged on a substrate of the electronic device, wherein the broadcasting reception antenna is supported by a metal bushing galvanically connected with the feed part of the broadcasting reception antenna, and operates in a retractable manner in the electronic device, and wherein the communicating antenna radiator is in direct contact with the metal bushing or is galvanically connected with the broadcasting reception antenna feed part by means of at least one of a metal contact part fixed to the metal bushing, a plurality of metal protrusions, a C-clip, and metal screw coupling.

2. The antenna apparatus of claim 1, wherein the broadcasting reception antenna operates in any one band of Terrestrial Digital Multimedia Broadcasting (TDMB), Digital Video Broadcasting-Handheld (DVB-H), One Seg, and Integrated Services Digital Broadcasting-Terrestrial (ISDB-T).

3. The antenna apparatus of claim 1, wherein the communicating antenna radiator is arranged in a case frame of the electronic device.

4. The antenna apparatus of claim 1, wherein the communicating antenna radiator is arranged in such a manner that it is attached to an external surface of a case frame of the electronic device, and is fed from the broadcasting reception antenna feed part in a manner that passes through the case frame.

5. The antenna apparatus of claim 1, wherein the communicating antenna radiator is fixed in a manner that it is insert-molded into a case frame of the electronic device, and an end thereof is protruded to an inner surface of the case frame and is fed from the broadcasting reception antenna feed part.

6. The antenna apparatus of claim 1, wherein the communicating antenna radiator is formed in a pattern form in a substrate of the electronic device and is fed from the broadcasting reception antenna feed part.

7. The antenna apparatus of claim 1, wherein the communicating antenna radiator is galvanically connected at one end to a capacitor mounted on a substrate of the electronic device to operate as an antenna apparatus of a loop form.

8. The antenna apparatus of claim 1, wherein the communicating antenna radiator operates in at least one band of a Global Positioning System (GPS) antenna, a British Telecom (BT) antenna, a Wireless Fidelity (WiFi) antenna, a main diversity antenna, and a Long Term Evolution (LTE) sub-antenna.

9. An electronic device comprising:

a broadcasting reception antenna configured to receive broadcasting; and at least one communicating antenna radiator arranged near the broadcasting reception antenna and galvanically connected to a feed part of the broadcasting reception antenna, wherein the communicating antenna radiator is arranged in proximity to the broadcasting reception antenna such that the communicating antenna radiator and the broadcasting reception antenna would mutually interfere due to coupling if galvanically isolated from each other, wherein the feed part of the broadcasting reception antenna is arranged on a substrate of the electronic device, wherein the broadcasting reception antenna is supported by a metal bushing galvanically connected with the feed part of the broadcasting reception antenna and operates in a retractable manner in the electronic device, and wherein the communicating antenna radiator is in direct contact with the metal bushing or is galvanically connected with the broadcasting reception antenna feed part by means of at least one of a metal contact part fixed to the metal bushing, a plurality of metal protrusions, a C-clip, and metal screw coupling.

10. The electronic device of claim 9, wherein the communicating antenna radiator is arranged in a case frame of the electronic device.

11. The electronic device of claim 9, wherein the communicating antenna radiator is arranged in a manner that it is attached to an external surface of a case frame of the electronic device and is fed from the broadcasting reception antenna feed part in a manner that passes through the case frame.

12. The electronic device of claim 9, wherein the communicating antenna radiator is fixed in a manner that it is insert-molded into a case frame of the electronic device and an end thereof is protruded to an inner surface of the case frame and is fed from the broadcasting reception antenna feed part.

13. The electronic device of claim 9, wherein the communicating antenna radiator is formed in a pattern form in a substrate of the electronic device and is fed from the broadcasting reception antenna feed part.

14. The electronic device of claim 9, wherein the communicating antenna radiator is galvanically connected at one end to a capacitor mounted on a substrate of the electronic device to operate as an electronic device of a loop form.

15. The electronic device of claim 9, wherein the broadcasting reception antenna operates in any one band of Terrestrial Digital Multimedia Broadcasting (TDMB), Digital Video Broadcasting-Handheld (DVB-H), One Seg, and Integrated Services Digital Broadcasting-Terrestrial (ISDB-T), and wherein the communicating antenna radiator operates in at least one band of a Global Positioning System (GPS) antenna, a British Telecom (BT) antenna, a Wireless Fidelity (WiFi) antenna, a main diversity antenna, and a Long Term Evolution (LTE) sub-antenna.

* * * * *